US006154242A

United States Patent [19]

Tuli

[11] Patent Number: 6,154,242

[45] Date of Patent: Nov. 28, 2000

[54] THERMAL PRINT HEAD ARRANGEMENT

[75] Inventor: Raja Singh Tuli, Montreal, Canada

[73] Assignee: Raja Tuli, Montreal, Canada

[21] Appl. No.: 09/039,405

[22] Filed: Mar. 16, 1998

[51] Int. Cl.[7] ..... B41J 2/345

[52] U.S. Cl. ..... 347/208

[58] Field of Search ..... 347/200, 208

[56] References Cited

U.S. PATENT DOCUMENTS 5,914,743 6/1999 Tagashira et al. ..... 347/208

FOREIGN PATENT DOCUMENTS 55-9302 3/1980 Japan ..... 347/200
2-72967 3/1990 Japan ..... 347/200
4-226769 8/1992 Japan ..... 347/200

*Primary Examiner*—Huan Tran

[57] ABSTRACT

A thermal print head arrangement for a thermal printer in which print lines of printing elements of adjacent print heads are parallel and spread across the width direction of a recording sheet, perpendicular to the lengthwise direction of travel of the recording sheet, with any two adjacent print heads having opposite orientations facing each other is provided. Print heads are cut at an oblique angle at both ends thus allowing them to be closely and consecutively arranged in alternate dispositions. The method for alignment of the print heads, involves the use of a microscope positioned above print elements of print heads. An alignment marker of the microscope's eyepiece is used to position the print heads on the print head support. Each adjacent print head is positioned with its oblique cut edge against the similar cut edge of the first print head and displaced to obtain the distance between end print elements of adjacent print heads equal to the internal distance of all print elements of each print head. The device for alignment of the print heads consists of a planar base support having a high precision linear bearing guide rail along one side, onto which a sliding block travels supporting a microscope and mounting device.

3 Claims, 4 Drawing Sheets

THERMAL PRINT HEAD ARRANGEMENT

BACKGROUND OF THE INVENTION

1. Field of the Invention

The present invention relates to the arrangement of thermal print heads in thermal recording devices with related methods and devices for aligning such print heads in these recording devices. More specifically, the invention relates to the arrangement of multiple narrow thermal print heads in wide format printers. The methods described in the present invention specifically relate to the alignment of such print heads in a manufacturing process or in service.

2. Description of the Related Art

In a thermal transfer printer, a transfer ribbon typically having a polyester backing coated on one side with a heat-transferable ink layer is interposed between the surface of a non sensitized paper and a thermal print head having a line of very small heater elements. When an electrical pulse is applied to a selected subset of the heater elements, localized melting and transfer of the ink to the paper occurs under the energized elements, resulting in a corresponding line of dots being transferred to the paper.

Thermal print heads in such thermal transfer printers are commonly composed of a plurality of linear thermal head segments or "tiles" aligned in the width direction of a recording medium sheet, perpendicular to the feeding direction or the lengthwise direction of the recording medium sheet, so that a predetermined number of thermal print elements of adjacent tiles overlap to cover the entire width of the recording medium sheet.

A typical thermal head segments arrangement, using the overlapping technique conforming to the Related Art, as described in U.S. Pat. No. 5,450,099 to Stephenson et al., is shown in FIG. 1.

Stephenson et al., describes in their patent a method of an apparatus for sequential printing lines of image pixels in the thermal printing of a two-dimensional image on a wide format media paper, employing a print head arrangement of the type comprising a plurality N of linear thermal print head segments heaving a set n of thermal print elements.

He uses an alternating, staggered pattern in first and a second rows of N1 and N2 print head segments arranged across the media in a print line direction such that respective subsets of n1 thermal print elements of the adjacent ends of the N1 and N2 print head segments arranged in the first and second rows, overlap one another in the print line direction.

However, a drawback of this overlapping method of print head arrangement is that it uses more thermal print elements than necessary for printing the information, thus increasing the complexity and the price of the print head.

Another major drawback of Stephenson's patent consists in the fact that the alignment of thermal print elements is very difficult to accomplish in both the manufacturing and servicing processes. This is due to the independent positioning and fixing of each print head segment, which can be displaced in two directions and can be rotated in the fixation plane. This creates a need for more operations to obtain a parallel arrangement between two adjacent thermal print line segments, the exact overlapping of the thermal print elements, and the linearity of thermal print segments of each row. This will also increase the cost of manufacturing or servicing.

SUMMARY OF THE INVENTION

The object of the present invention is to provide an improved thermal print head arrangement of narrow print heads in wide format thermal printers, which reduces the number of redundant thermal printing elements.

Another object of this invention is to provide an efficient and accurate method and device to align this improved print head arrangement in their manufacturing and servicing processes.

The present invention provides a thermal print head arrangement for a thermal printer in which the print lines of printing elements of adjacent print heads are parallel and spread across the width direction of a recording sheet, perpendicular to the lengthwise direction of travel of the recording sheet, with two adjacent print heads having opposite orientations facing each other.

In accordance with the present invention, the print head is comprised of thermal print elements arranged in a linear and equidistant disposition along the width of each print head.

Furthermore, in accordance with the present invention, to eliminate the cumbersome redundant overlapping of thermal print elements of all adjacent print heads, a cut at angle of 45° is introduced at both ends of each print head thus allowing them to be closely and consecutively arranged in alternate dispositions, and aligned to one another in such a way that the end print element of adjacent print heads are spaced equal to internal print elements resulting in a uniform distribution of the thermal print elements along the printing media width.

To achieve the foregoing objective in accordance with the purpose of this invention as embodied and broadly described herein, a method and a device for alignment of the improved print heads in the areas of manufacturing and servicing thereof follow.

The method for alignment of the print heads in their manufacturing and servicing processes, in accordance with this invention, consists in a first aspect, the use of a microscope positioned above a linear disposition of print heads on a print head support, whereby thermal print elements of each print head are visible in the microscope's eyepiece.

In a second aspect, the microscope moves parallel to a linear array of print elements of the print heads, and the print head support can move in a horizontal plane perpendicular to the linear arrangement of the print elements.

A first alignment marker of the microscope's eyepiece is positioned over one corner of the print elements of a first print head, and the microscope moved over to the other end of the print head in a straight line, with the print head adjusted beneath the same alignment marker and fastened in place onto the print head support. The traversing microscope is used to align each end of individual print heads parallel to its path.

In the next step of the alignment process, a second adjacent print head is positioned with its oblique cut edge against the similar cut edge of the first print head and displaced in an oblique direction, sliding parallel to the oblique cut edge of the first print head. This second print head is positioned such that the distance between print elements of the adjacent print heads is equal to the internal distance of all print elements (equidistant) of each print head. This is accomplishing with the aid of other alignment markers within the microscope's eyepiece.

The traversing microscope is moved in the same straight line to the other end of the second print head with similar alignment procedures to make the row of print elements parallel to its path.

This alignment process repeats for each print head by sliding the microscope along its guide rail in one continuous straight line, for all print heads, arranging all print lines parallel and staggered to each other.

The device for alignment of the print heads consists of a flat rectangular base support having a high precision linear bearing guide rail along one side, onto which a sliding block travels supporting a microscope mounting device. The microscope viewing direction is perpendicular to the support surface.

The print head support has two markers along its centerline one at each end, and these markers are used to position the printhead support parallel to the path of the traversing microscope.

The print head support could be offset adjusted at each end by use of adjusting screws.

BRIEF DESCRIPTION OF THE DRAWINGS

The accompanying drawings, which are incorporated in and constitute a part of the specification, illustrate a presently preferred embodiment of the invention and, together with the general description given above and the detailed description of the preferred embodiment given below, serve to explain the principles of the invention.

DETAILED DESCRIPTION OF THE PRINCIPAL EMBODIMENTS

Figure 1:
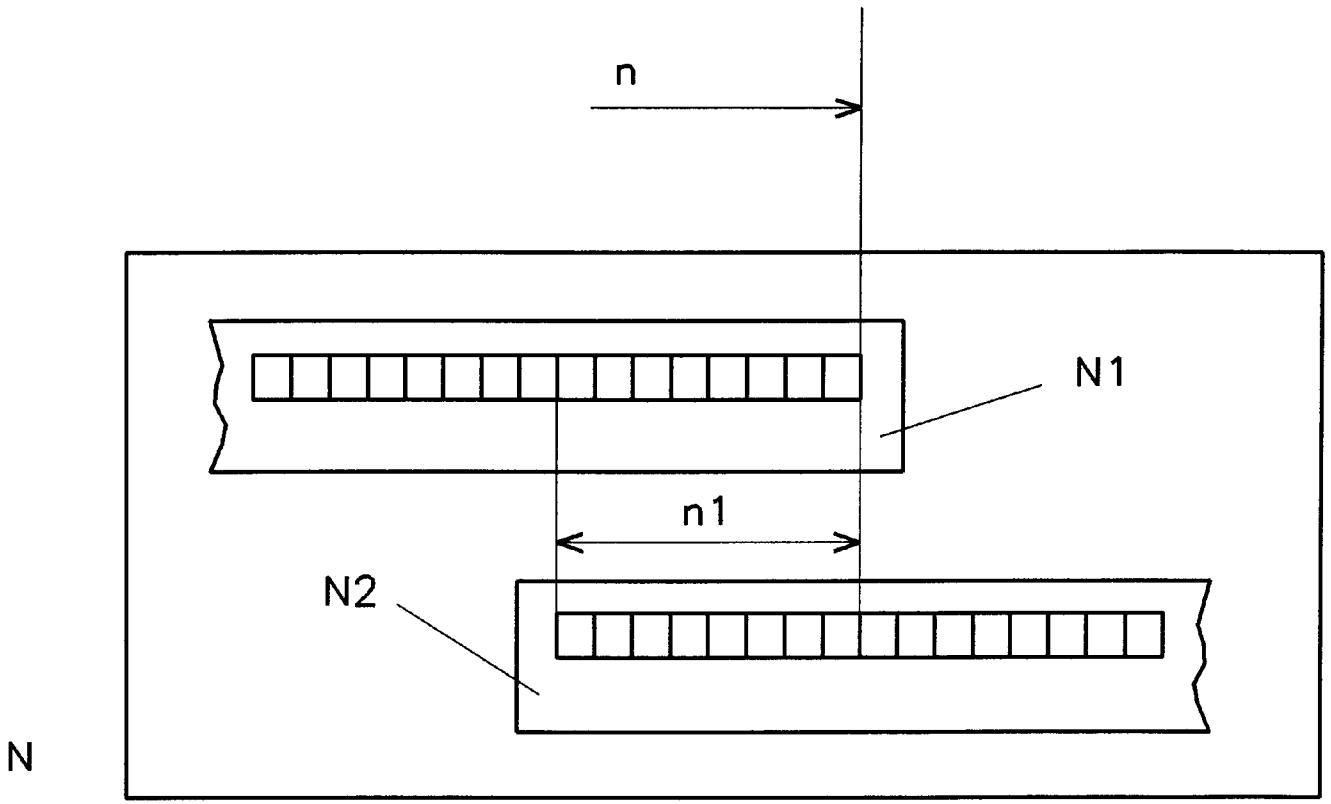
FIG. 1 is a schematic view illustrating the overlapping technique of the print head elements corresponding with the prior Related Art, as described in U.S. Pat. No. 5,450,099 to Stephenson et al.
Figure 2:
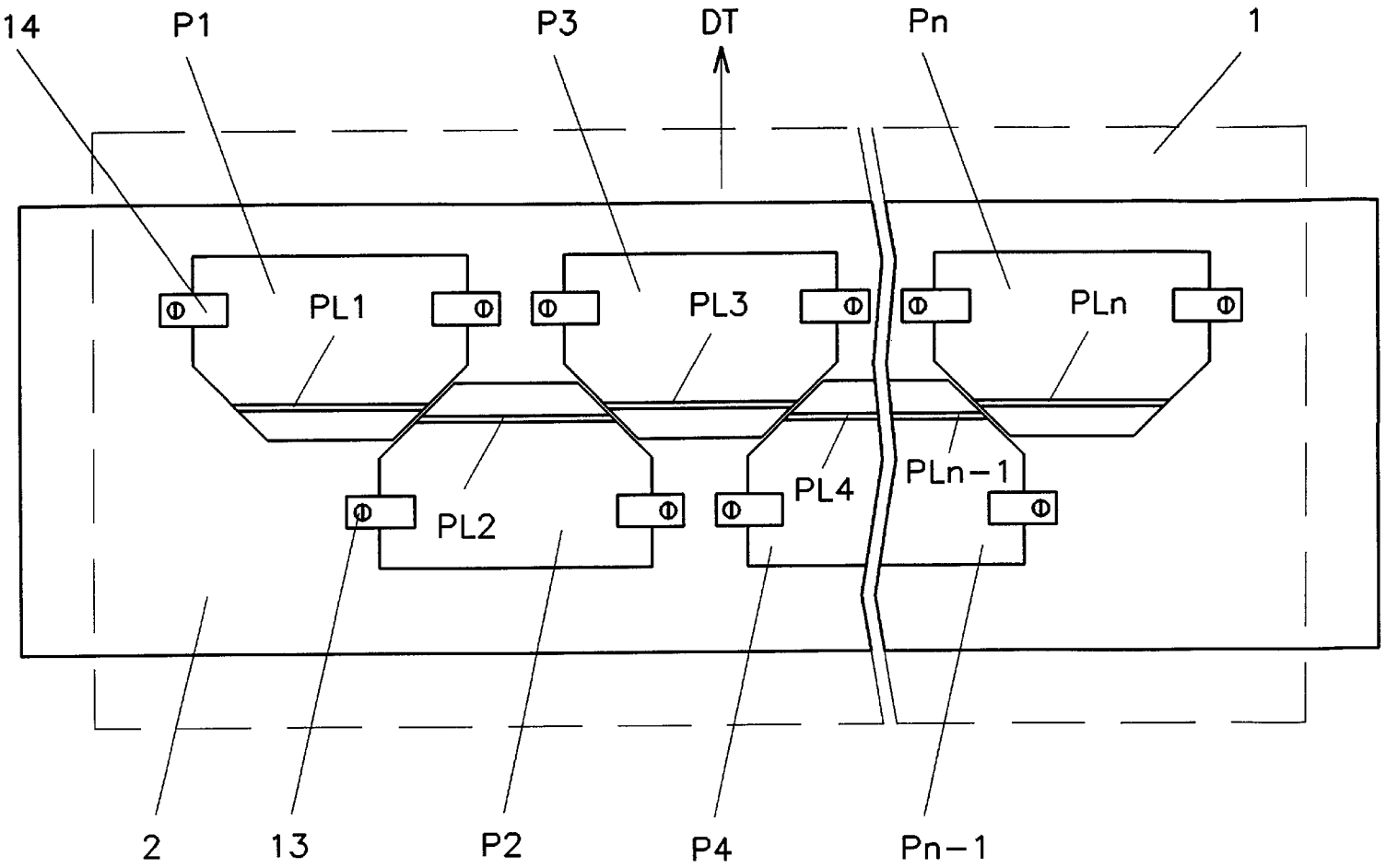
Fig. 2 is a top view of the print head support and the arrangement of the print heads, corresponding to the present invention.
Figure 3:
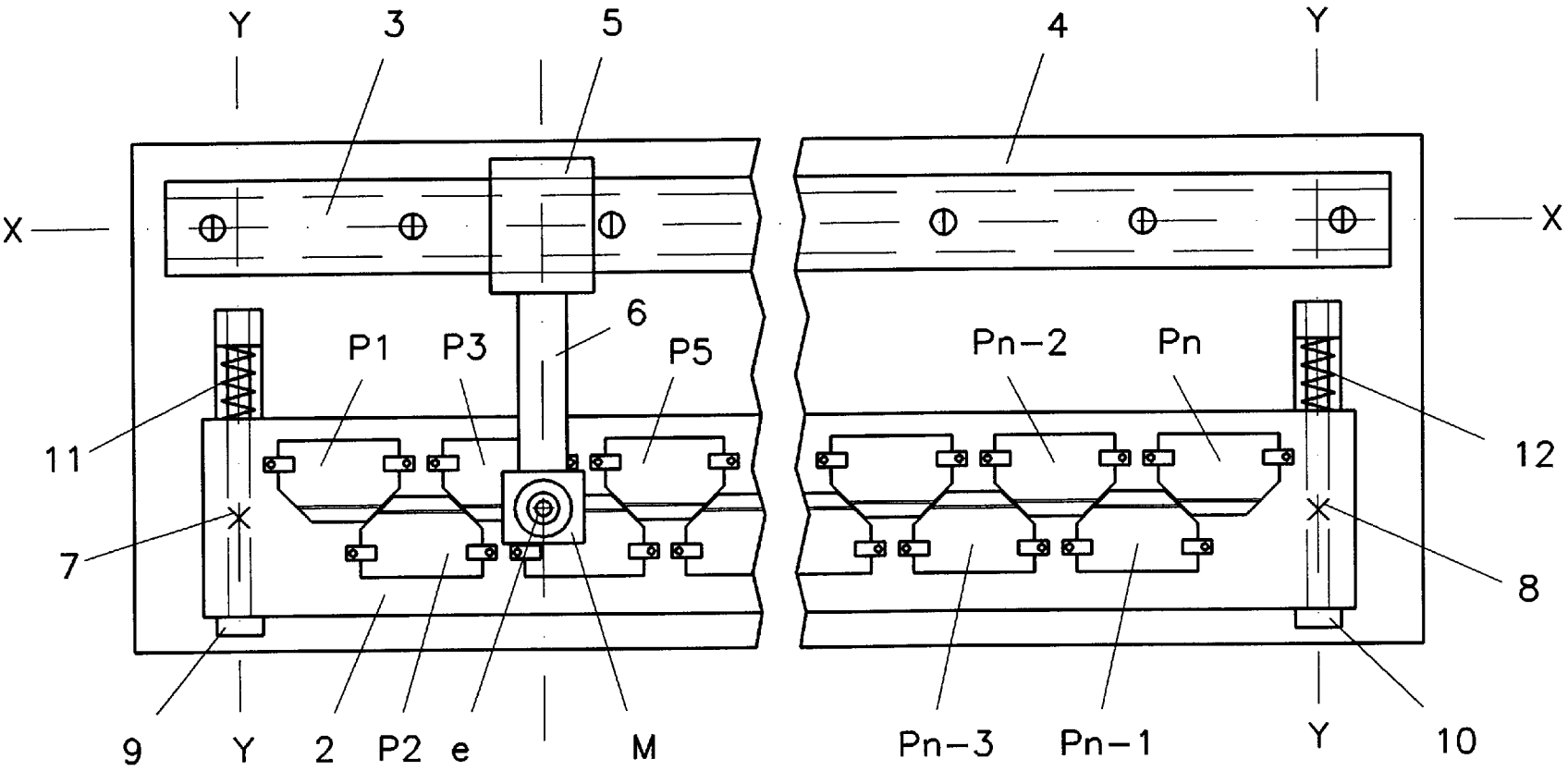
FIG. 3 is a top view of the alignment device, corresponding to the present invention.
Figure 4:
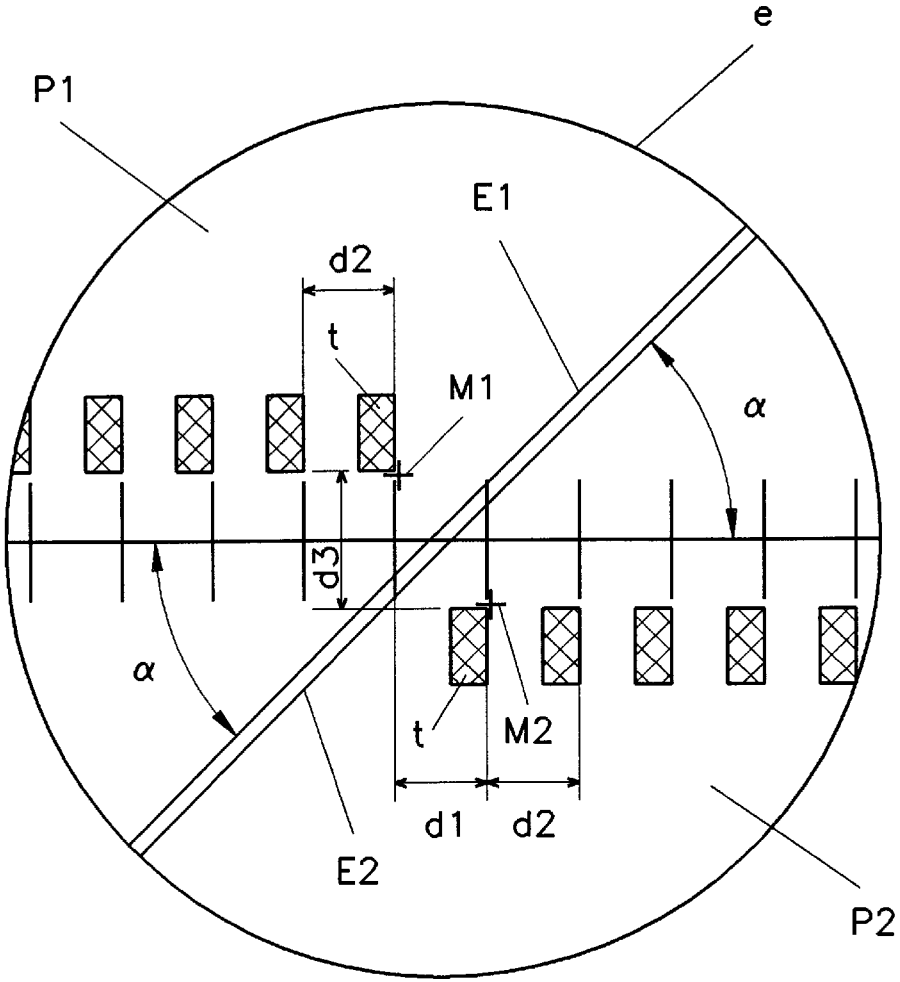
FIG. 4 is a detailed view of the adjacent area of two print heads as viewed through the microscope's eyepiece, corresponding to the present invention.

Reference will be now made in detail to the present preferred embodiment of the invention as illustrated in the accompanying drawings shown in Fig. 2 to Fig. 4 and set forth in the appended claims.

A thermal print head arrangement for a thermal printer according to the preferred embodiment of the present invention is shown in FIG. 2 in which print lines PL1 to PLn of adjacent print heads P1 to Pn are parallel and spread across the width direction of a recording sheet 1, perpendicular to a lengthwise direction of travel DT of a recording sheet 1, with two adjacent print heads having opposite orientations facing each other. Once precisely positioned, each print head is secured in place by means of screws 13 and clamps 14 onto a printhead support 2.

In accordance with the present invention, a print head is comprised of thermal print elements t arranged in a linear and equidistant disposition along the width of each print head as illustrated in FIG. 4.

Referring further to FIG. 4, to eliminate the cumbersome redundant overlapping of thermal print elements t of all adjacent print heads P1 and P2, P2 and P3, etc., a cut at angle a of 45° is introduced at both ends of each print head thus allowing them to be closely and consecutively arranged in alternate dispositions.

The print heads P1 to Pn are aligned to one another in such a way that end print elements t of adjacent print heads P1 and P2 are spaced equally at a distance d2 to internal print elements resulting in a uniform distribution of the thermal print elements t along the printing media width 1 as illustrated in FIG. 2 and FIG. 4.

The method for alignment of the print heads P1 to Pn in their manufacturing and servicing processes, in accordance with this invention as illustrated in FIG. 3, involves in a first aspect, the use of a microscope M positioned above a linear disposition of print heads on a print head support 2, whereby thermal print elements t are visible in the microscope's eyepiece e.

Further, the microscope M moves parallel to the linear array of print elements t of the print heads. Also, the print head support 2 moves in a horizontal plane in a Y—Y direction perpendicular to the linear arrangement of the print elements again illustrated in FIG. 3.

Referring to FIG. 3 and 4, a first alignment marker M1 of the microscope's eyepiece e is positioned over one corner of the end print element t of the first print head P1, and the microscope M moved over to the other end of the print head in a straight line X—X, with the print head P1 adjusted beneath the same alignment marker M1 at a corresponding corner of the other end print element t, and the print head fastened in place onto the print head support 2. The traversing microscope M is used to align each end of individual print heads P1 to Pn parallel to its path X—X. In the next step of the alignment process, the second adjacent print head P2 is positioned with its oblique cut edge E2 against the similar cut edge E1 of the first print head P1 and displaced in an oblique direction, sliding parallel to the oblique cut edge E1 of the first print head. This second print head P2 is positioned such that the distance d1 between print elements of the adjacent print heads P1 and P2 is equal to the internal distance d2 of all print elements t equidistant for each print head P1 to Pn. This is accomplished with the aid of other alignment markers M2 within the microscope's eyepiece e (FIG. 4). The traversing microscope M is moved in the same straight line to the other end of the second print head P2 with similar alignment procedures to make the row of print elements t parallel to its path X—X. This alignment process repeats for each print head from P1 to Pn by sliding the microscope M along a guide rail 3 in one continuous straight line, for all print heads, arranging all print lines PL1 to PLn parallel and staggered to each other. Hence, the print head support contains two linear arrays of print elements at a fixed distance d3 parallel to each other.

The device for alignment the print heads P1 to Pn is described with reference to FIG. 3 as follows.

The device consists of a flat rectangular base support 4 having a high precision planar linear bearing guide rail 3 along one side, onto which a sliding block 5 travels supporting a microscope mounting device 6. The microscope M viewing direction is perpendicular to the base support 4 planar surface.

The print head support 2 has two markers 7 and 8 along its centerline one at each end, and these markers are used to position the centerline of printhead support 2 parallel to the path X—X of the traversing microscope M.

The print head support 2 could be offset adjusted at each end by use of adjusting screws 9 and 10. The displacement of the print head support 2 is assisted by the compressive force of springs 11 and 12. Hence, the linear arrays of print elements can be positioned in close proximity and parallel to the axis passing through markers 7 and 8.

Additional advantages and modifications will be readily apparent to those skilled in the art. The invention in its broader aspects is, therefore, not limited to the specific details, representative method and device, and illustrative examples shown and described. Accordingly, departures may be made from such details without departing from the spirit or scope of the general inventive concept as defined by the appended claims and their equivalents.

What is claimed is:

1. A thermal print head arrangement for a thermal printer in which:

individual print heads are comprised of thermal print elements arranged in a linear and equidistant disposition along the width of each print head to form a print line;

an oblique cut edge is introduced at both ends of each print head at an angle thus allowing them to be closely and consecutively arranged in alternate dispositions, and aligned to one another in such a way that the end print elements of adjacent print heads are spaced equal to internal print element distances, resulting in a uniform distribution of the thermal print elements along the arrangement of print heads;

print lines of adjacent print heads are parallel and spread across the width direction of a recording sheet, perpendicular to the lengthwise direction of travel of the recording sheet, with any two adjacent print heads having opposite orientations facing each other.

2. A method for alignment of a print head arrangement as claimed in claim 1, in which:

a microscope is positioned above a linear disposition of print heads attached to a print head support, whereby thermal print elements of each print head are visible in the microscope's eyepiece;

the microscope moves parallel to the linear disposition of print elements of multiple print heads, whereby the print head support can move in a horizontal plane perpendicular to the linear arrangement of the print elements;

a first alignment marker within the microscope's eyepiece is positioned over one end print element of a first print head, and the microscope moved over to the other end print element in a straight line, with the print head adjusted beneath the same alignment marker at corresponding locations on print elements, and fastened to the print head support in this position;

an adjacent print head is positioned with its oblique cut edge against a similar oblique edge of the first print head and displaced in a direction parallel to the oblique edge of the first print head;

adjacent print heads are positioned such that the distance between end print elements of adjacent print heads is equal to the preset equidistant internal distance of all print elements of each print head, with the aid of other alignment markers within the microscope's eyepiece;

the microscope is moved in a straight line from one end of the print head support to the other, with similar alignment procedures for consecutive adjacent print heads, to form two equidistant rows of print elements parallel to the microscope's axial direction of travel.

3. A device for alignment of print heads as claimed in claims 1 and 2 in which:

a planar base support having a high precision linear bearing guide rail along one side, onto which a sliding block travels supporting a microscope mount and microscope is provided, whereby the microscope's viewing axis is perpendicular to the base support;

the print head support has two markers along its centerline, one at each end, and these markers are used to position the centerline of the printhead support parallel to the linear guide rail;

the print head support is offset adjusted at each end by adjusting screws acting against the compressive force of springs displacing the print head support away from or towards the linear guide rail.

* * * * *